US009557063B2

(12) United States Patent
Cadima

(10) Patent No.: US 9,557,063 B2
(45) Date of Patent: Jan. 31, 2017

(54) BURNER ASSEMBLY FOR COOKTOP APPLIANCE AND METHOD FOR OPERATING SAME

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 518 days.

(21) Appl. No.: 14/087,032

(22) Filed: Nov. 22, 2013

(65) Prior Publication Data

US 2015/0144123 A1 May 28, 2015

(51) Int. Cl.

| | |
|---|---|
| ***F23D 23/00*** | (2006.01) |
| ***F24C 3/12*** | (2006.01) |
| ***F24C 3/08*** | (2006.01) |
| ***F23N 1/00*** | (2006.01) |
| ***F23D 14/06*** | (2006.01) |

(52) U.S. Cl.

CPC ..... *F24C 3/126* (2013.01); *F23D 14/06* (2013.01); *F23D 23/00* (2013.01); *F23N 1/007* (2013.01); *F24C 3/085* (2013.01); *F23D 2900/14064* (2013.01)

(58) Field of Classification Search

CPC ..... F23D 23/00; F23D 2900/14062; F23D 2900/14064; F23N 1/007

USPC ..... 431/60, 280; 126/39 H, 39 R

See application file for complete search history.

(56) References Cited

U.S. PATENT DOCUMENTS

| | | | | |
|---|---|---|---|---|
| 3,146,794 | A * | 9/1964 | Hollman | F16K 11/0743 137/625.15 |
| 4,083,355 | A * | 4/1978 | Schwank | F23D 14/14 126/39 J |
| 4,951,650 | A * | 8/1990 | Boyes | F24C 3/006 126/92 AC |
| 6,198,080 | B1 * | 3/2001 | Rice | F24C 7/082 219/412 |
| 6,949,723 | B2 * | 9/2005 | Staebler | H05B 3/74 219/445.1 |
| 7,527,495 | B2 | 5/2009 | Yam et al. | |
| 7,661,954 | B2 * | 2/2010 | Harneit | F23D 14/06 431/278 |
| 8,011,358 | B2 | 9/2011 | Galindo et al. | |
| 8,258,437 | B2 * | 9/2012 | Donarski | H05B 1/0266 219/443.1 |

(Continued)

FOREIGN PATENT DOCUMENTS

| | | | | |
|---|---|---|---|---|
| IT | WO 2008141916 | A2 * | 11/2008 | F23N 1/007 |
| IT | WO 2008141916 | A3 * | 11/2009 | F23N 1/007 |

*Primary Examiner* — Jorge Pereiro

(74) *Attorney, Agent, or Firm* — Dority & Manning, P.A.

(57) ABSTRACT

Burner assemblies and methods for operating burner assemblies are provided. A method includes outputting a maximum gaseous fuel supply to a first burner and no gaseous fuel supply to a second burner when a burner assembly knob is in a first position, outputting a minimum gaseous fuel supply to the first burner and no gaseous fuel supply to the second burner when the knob is in a second position, outputting a minimum gaseous fuel supply to the first burner and a maximum gaseous fuel supply to the second burner when the knob is in a third position, and outputting a minimum gaseous fuel supply to the first burner and a minimum gaseous fuel supply to the second burner when the knob is in a fourth position.

17 Claims, 7 Drawing Sheets

(56) References Cited

U.S. PATENT DOCUMENTS

| | | | | |
|---|---|---|---|---|
| 8,978,637 | B2 * | 3/2015 | Ryu | F23D 14/06 126/39 K |
| 9,217,572 | B2 * | 12/2015 | Park | F24C 3/085 |
| 2002/0164553 | A1 * | 11/2002 | Distaso | F24C 3/067 431/280 |
| 2002/0190057 | A1 * | 12/2002 | Staebler | H05B 3/74 219/506 |
| 2004/0007566 | A1 * | 1/2004 | Staebler | H05B 3/74 219/445.1 |
| 2006/0081237 | A1 * | 4/2006 | Chung | F23D 14/045 126/39 E |
| 2007/0151556 | A1 * | 7/2007 | Cadima | F24C 3/085 126/39 E |
| 2008/0202495 | A1 * | 8/2008 | Caloca Galindo | F23D 14/58 126/39 E |
| 2010/0252020 | A1 * | 10/2010 | Siow | F24C 3/126 126/25 R |
| 2010/0263657 | A1 * | 10/2010 | Ryu | F24C 3/085 126/39 E |
| 2010/0263658 | A1 * | 10/2010 | Ryu | F24C 3/085 126/39 E |
| 2011/0147366 | A1 * | 6/2011 | Franca | H05B 1/0266 219/443.1 |
| 2011/0186037 | A1 * | 8/2011 | Ryu | F23D 14/06 126/39 K |
| 2011/0290782 | A1 * | 12/2011 | Donarski | H05B 1/0202 219/443.1 |

* cited by examiner

FIG. —1—

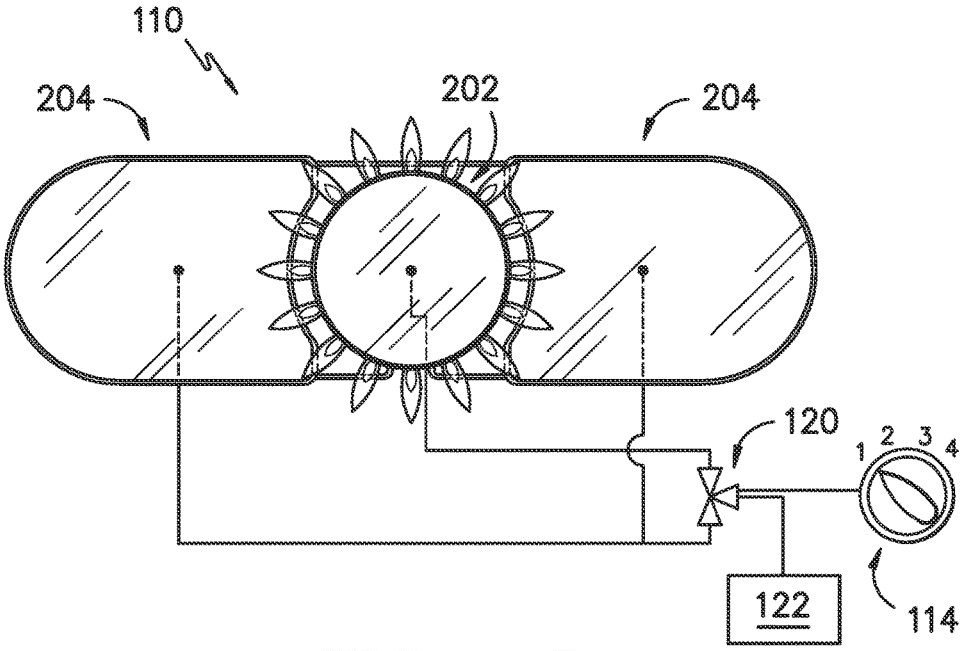
FIG. —5—
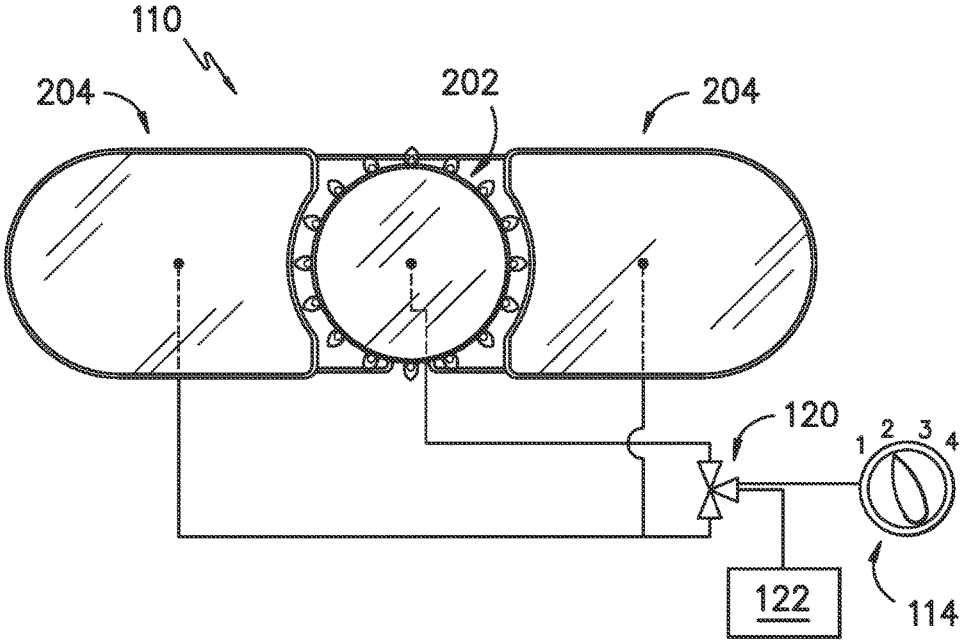
FIG. —6—

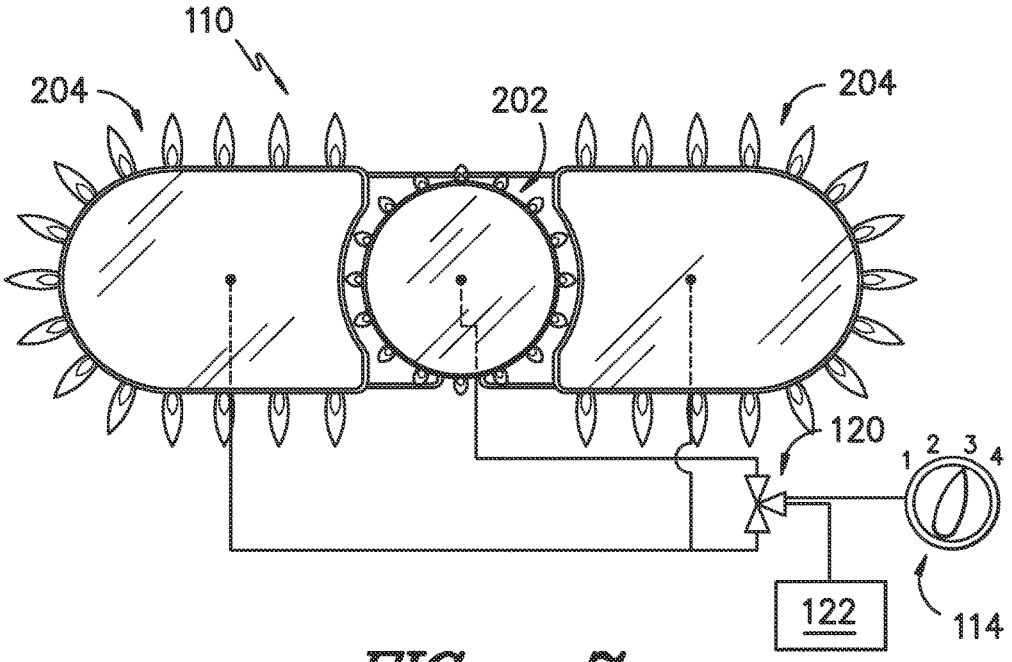
FIG. —7—
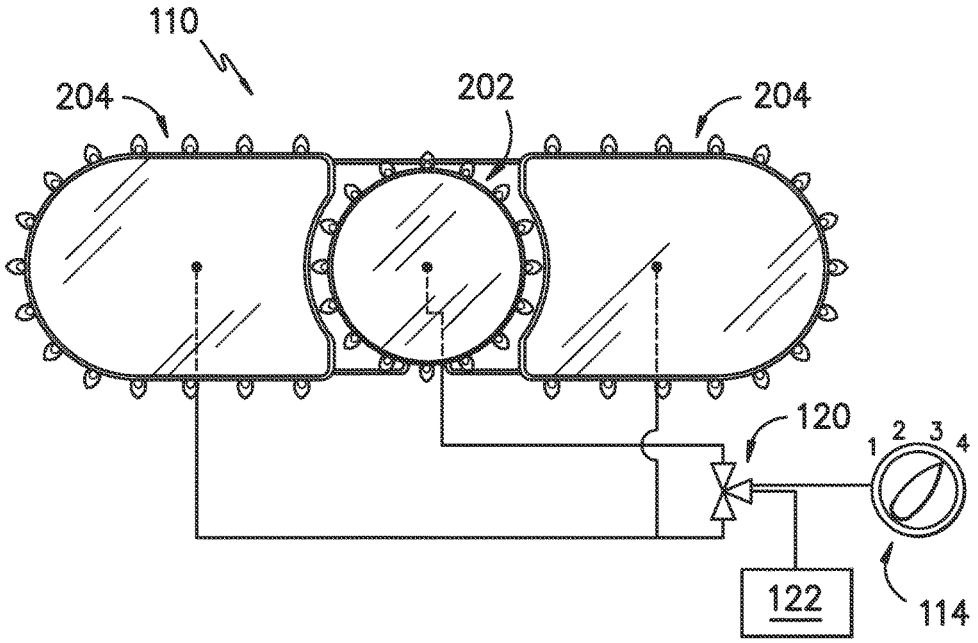
FIG. —8—

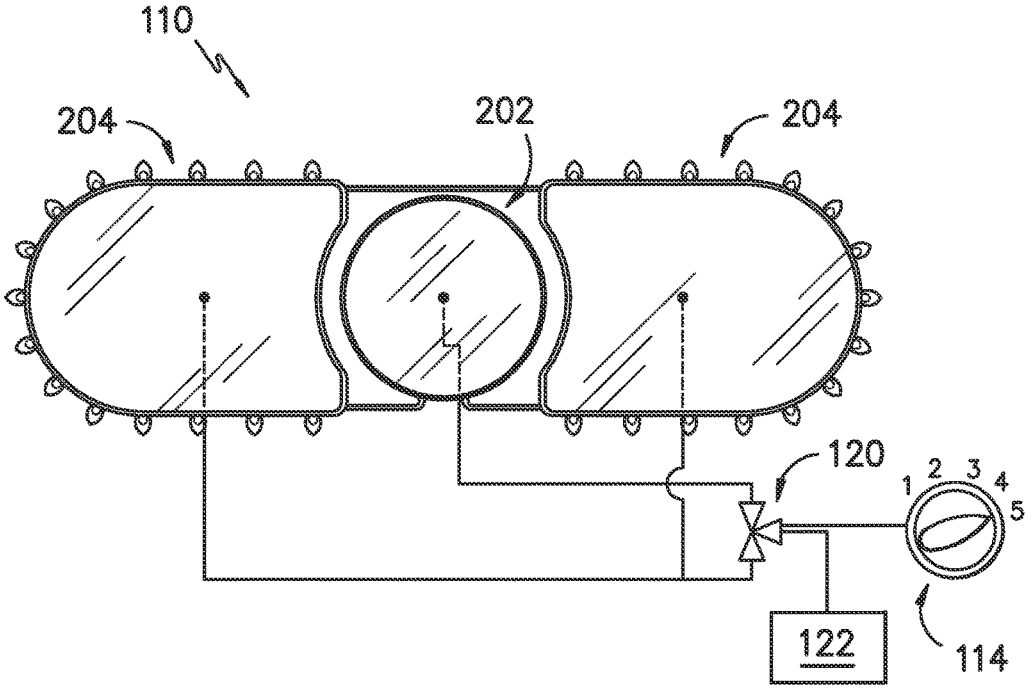
FIG. —9—

BURNER ASSEMBLY FOR COOKTOP APPLIANCE AND METHOD FOR OPERATING SAME

FIELD OF THE INVENTION

The present subject matter relates generally to cooktop appliances and gas burners for the same.

BACKGROUND OF THE INVENTION

Cooktop appliances generally include burners for heating, for example, food items. Gas cooktop appliances ignite gaseous fuel, such as propane or natural gas, to produce such heat. A cooking utensil, such as a pot or pan, containing, for example, a foot item, is placed on the burner for heating. Typical burners for cooktop appliances have generally circular shapes. Recently, however, elongated burners have been utilized to heat large or elongated containers, such as griddles. Many known elongated burners have oval-like shapes, with for example opposing long straight sides and opposing short curved sides.

Due to customer concerns regarding the utility of such elongated burners, attempts have been made to increase the versatility of such burners. In one arrangement, the burner was manufactured such that various portions of the elongated burner could be individually used. However, controls for this arrangement were discovered to be difficult to manipulate, and none of the individual portions were designed for use with circular cooking utensils.

In another arrangement, a cooking utensil was placed in the center of the elongated burner, and either burner could be utilized depending on the application. However, difficulties with this design have presented themselves. For example, such design does not provide sufficient secondary air to the circular burner. Further, users of such design have experienced excess heat generation issues, with the overall temperature from the circular burner and elongated burner being beyond that temperatures that can be withstood by, for example, non-stick coatings of certain containers.

Accordingly, improved burners and operating methods for cooktop appliances are desired in the art. In particular, methods and burner assemblies which allow, for example, griddle use while preventing excess heat generation issues and decreasing air supply issues would be advantageous.

BRIEF DESCRIPTION OF THE INVENTION

In a first exemplary embodiment, a method for operating a burner assembly is provided. The burner assembly includes a first burner and a second burner each defining a plurality of outlets for directing gaseous fuel therefrom, the second burner having a shape different from a shape of the first burner. The method includes outputting a maximum gaseous fuel supply to the first burner and no gaseous fuel supply to the second burner when a burner assembly knob is in a first position, outputting a minimum gaseous fuel supply to the first burner and no gaseous fuel supply to the second burner when the knob is in a second position, outputting a minimum gaseous fuel supply to the first burner and a maximum gaseous fuel supply to the second burner when the knob is in a third position, and outputting a minimum gaseous fuel supply to the first burner and a minimum gaseous fuel supply to the second burner when the knob is in a fourth position.

In a second exemplary embodiment, a burner assembly of a cooktop appliance is provided. The burner assembly includes a first burner defining a plurality of outlets for directing gaseous fuel therefrom, and a second burner defining a plurality of outlets for directing gaseous fuel therefrom, the second burner having a shape different from a shape of the first burner. The burner assembly further includes a knob operable to control a gaseous fuel supply to the first burner and a gaseous fuel supply to the second burner. The knob is movable to a first position wherein the first burner outputs a maximum gaseous fuel supply and the second burner outputs no gaseous fuel supply, a second position wherein the first burner outputs a minimum gaseous fuel supply and the second burner outputs no gaseous fuel supply, a third position wherein the first burner outputs a minimum gaseous fuel supply and the second burner outputs a maximum gaseous fuel supply, and a fourth position wherein the first burner outputs a minimum gaseous fuel supply and the second burner outputs a minimum gaseous fuel supply.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 illustrates a first burner and second burner of a burner assembly for a cooktop appliance when an associated knob is in a first position;

FIG. 6 illustrates a first burner and second burner of a burner assembly for a cooktop appliance when an associated knob is in a second position;

FIG. 7 illustrates a first burner and second burner of a burner assembly for a cooktop appliance when an associated knob is in a third position;

FIG. 8 illustrates a first burner and second burner of a burner assembly for a cooktop appliance when an associated knob is in a fourth position; and FIG. 9 illustrates a first burner and second burner of a burner assembly for a cooktop appliance when an associated knob is in a fifth position.

DETAILED DESCRIPTION

Figure 1:
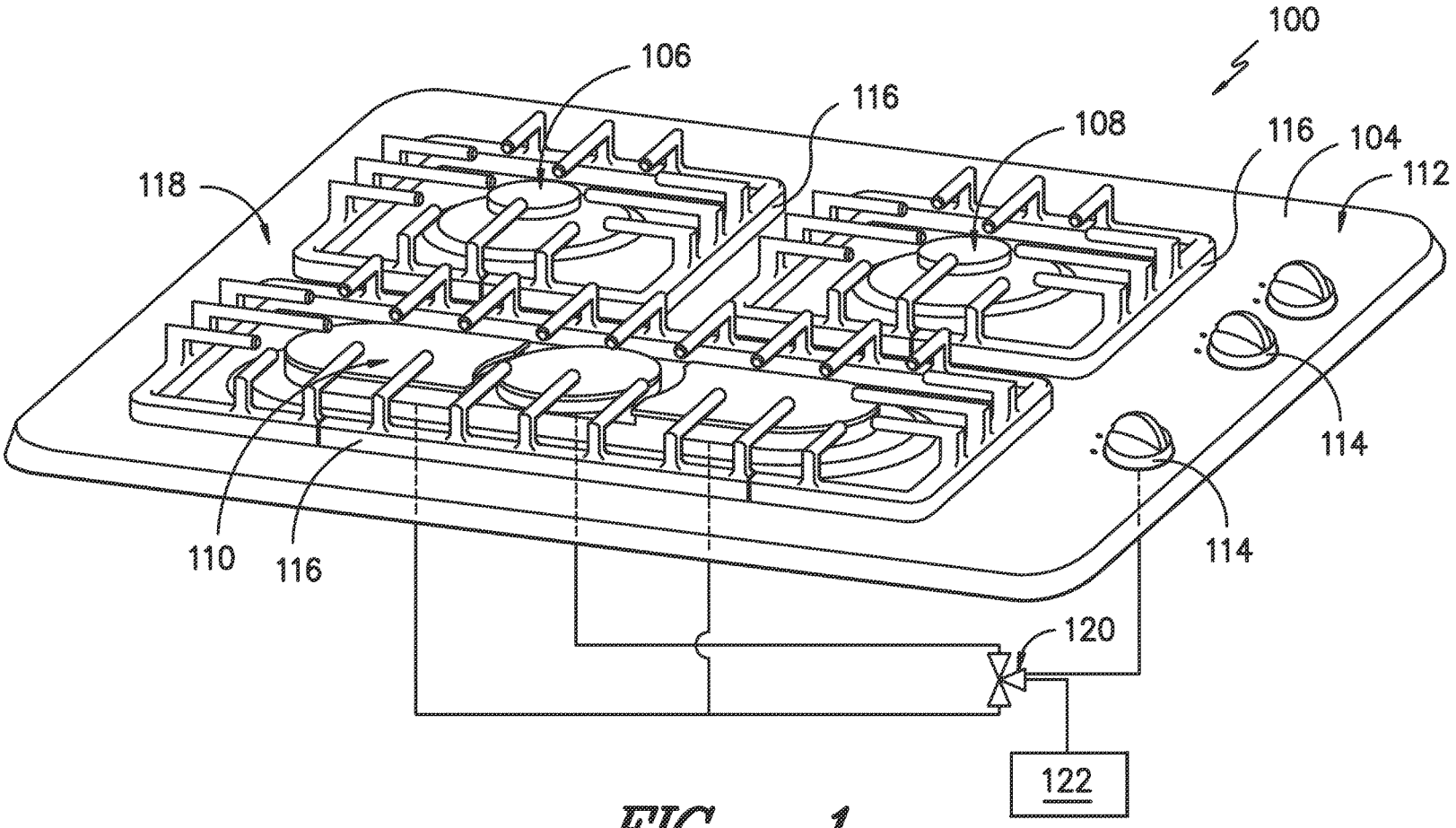
FIG. 1 provides a perspective view of a cooktop appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a top panel 104. By way of example, top panel 104 may be constructed of glass, ceramics, enameled steel, and combinations thereof.

For cooktop appliance 100, a utensil holding food and/or cooking liquids (e.g., oil, water, etc.) may be placed onto grates 116 at a location of any of burner assemblies 106, 108, 109, and 110. Burner assemblies 106, 108 and 110 provide thermal energy to cooking utensils on grates 116. As shown in FIG. 1, burners assemblies 106, 108 and 110 can be configured in various sizes so as to provide e.g., for the receipt of cooking utensils (i.e., pots, pans, etc.) of various sizes and configurations and to provide different heat inputs for such cooking utensils. Grates 116 are supported on a top surface 118 of top panel 104.

A user interface panel 112 is located within convenient reach of a user of the cooktop appliance 100. For this exemplary embodiment, panel 112 includes burner assembly knobs 114 that are each associated with one of burner assemblies 106, 108 and 110. Knobs 114 allow the user to activate each burner assembly and determine the amount of heat input provided by each burner assembly 106, 108 and 110 to a cooking utensil located thereon. For example, a knob 114 may control the gaseous fuel supply to an associated burner assembly 106, 108, 110. In exemplary embodiments, knob 114 may be connected to a valve 120. The valve 120 may be connected between a gaseous fuel supply 122 and a burner assembly 106, 108, 110. Gaseous fuel may thus flow through the valve 120 to the burner assembly 106, 108, 110. Valve 120 may thus be configured to supply gaseous fuel to a burner assembly 106, 108, 110, and knob 114 may control the valve 120 and thus control the gaseous fuel supply from and through the valve 120.

Panel 112 may also be provided with one or more graphical display devices that deliver certain information to the user such as e.g., whether a particular burner assembly is activated and/or the level at which the burner assembly is set.

Although shown with knobs 114, it should be understood that knobs 114 and the configuration of cooktop appliance 100 shown in FIG. 1 is provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
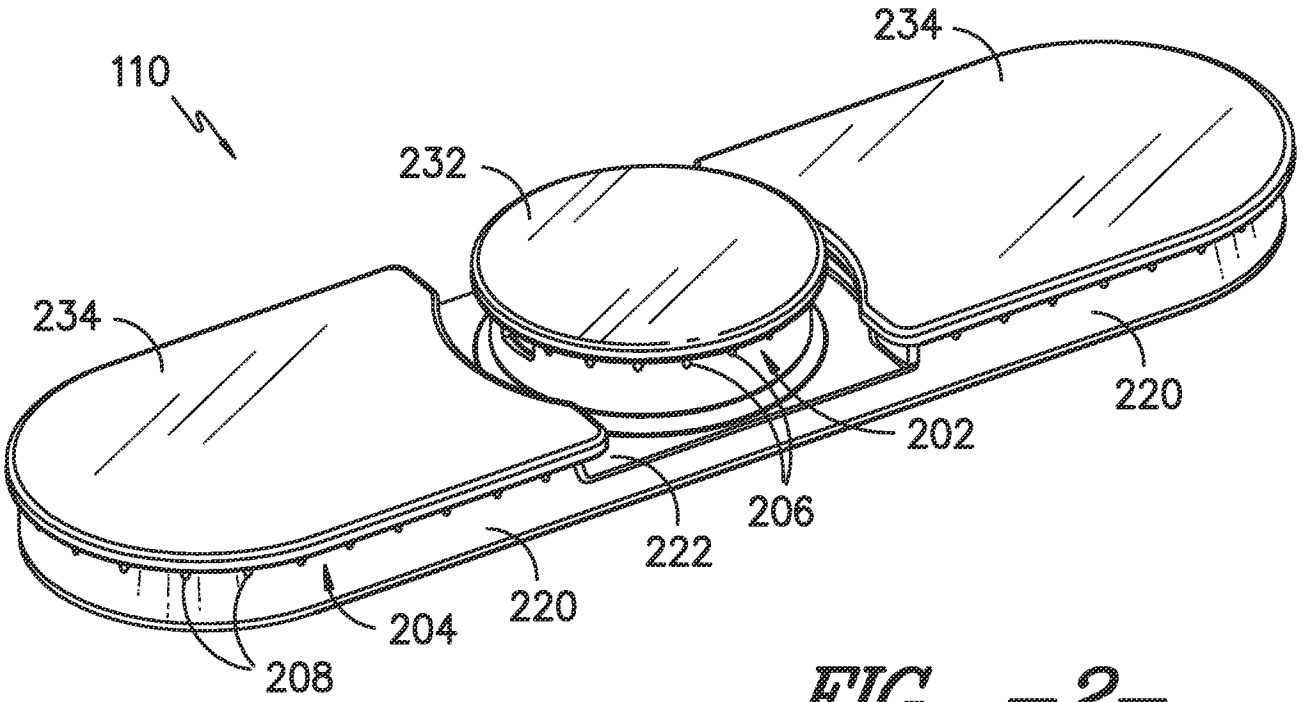
FIG. 2 provides a perspective view of a burner assembly for a cooktop appliance in accordance with one embodiment of the present disclosure.
Figure 3:
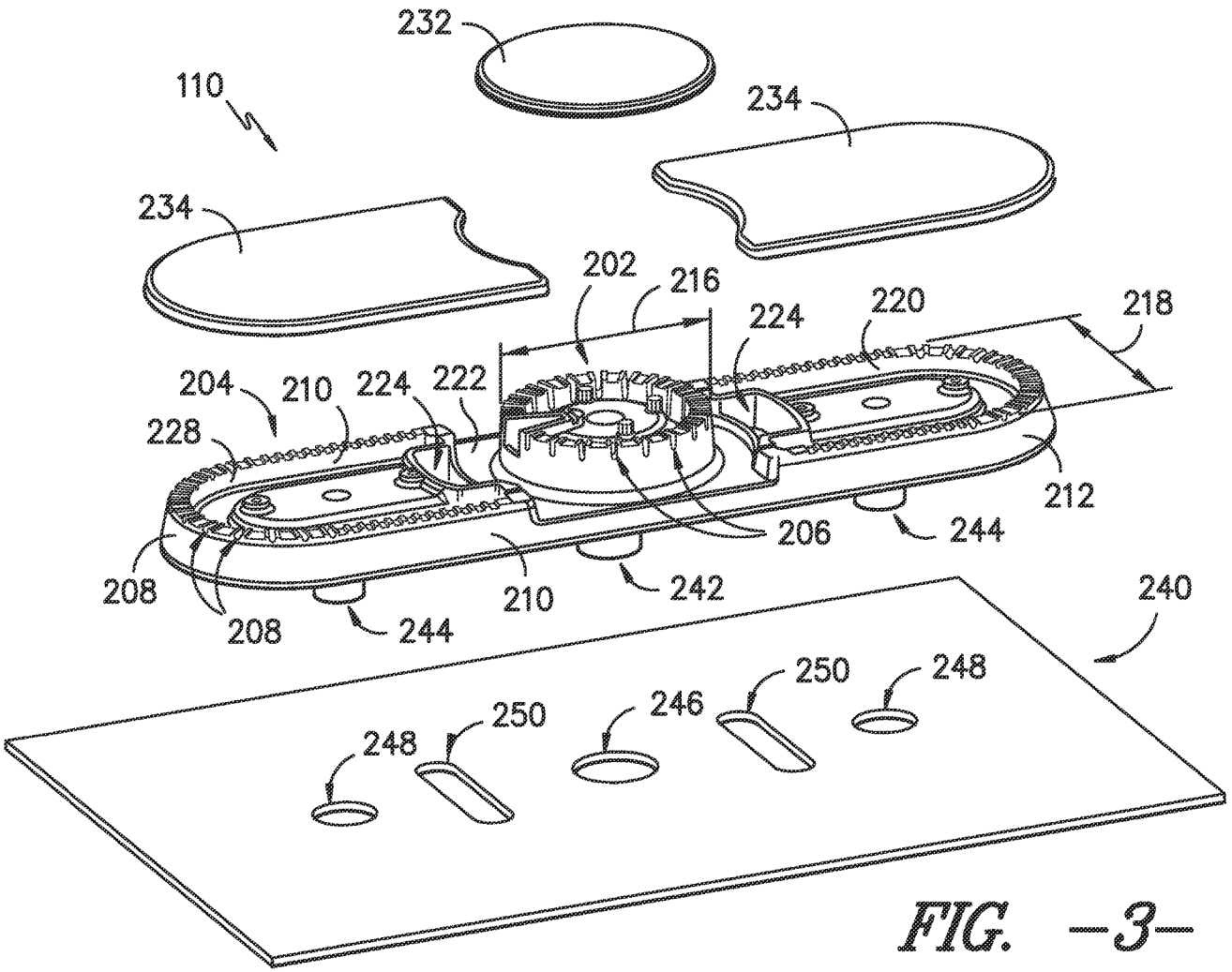
FIG. 3 provides a perspective exploded view of a burner assembly for a cooktop appliance in accordance with one embodiment of the present disclosure.
Figure 4:
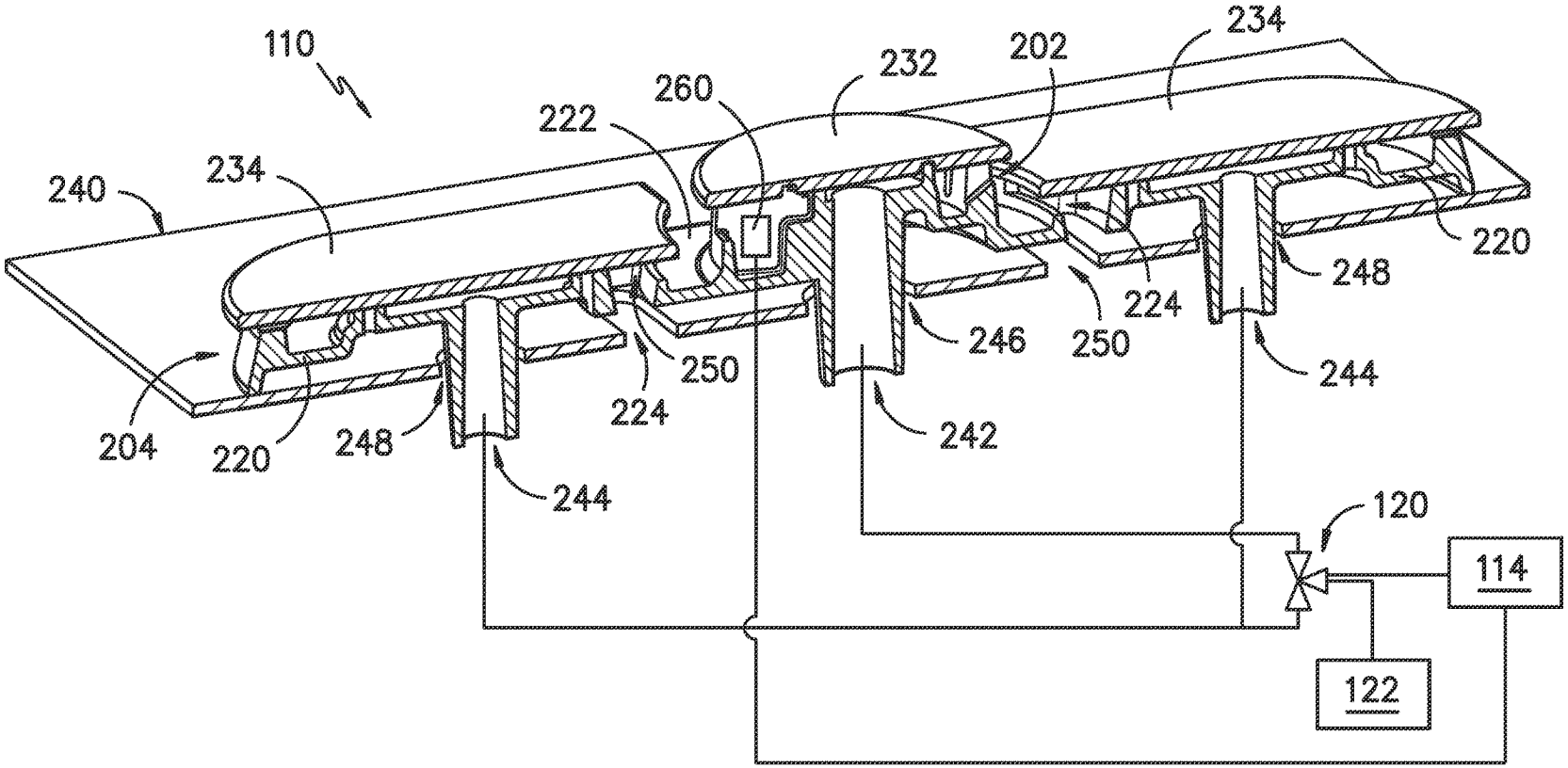
FIG. 4 provides a cross-sectional view of a burner assembly for a cooktop appliance in accordance with one embodiment of the present disclosure.

Referring now to FIGS. 2 through 4, embodiments of a burner assembly 110 are illustrated. Burner assembly 110 generally includes a first burner 202 and a second burner 204. The burners 202, 204 each include and define outlets 206, 208, respectively, for directing gaseous fuel therefrom. The outlets 206 are generally spaced apart about a perimeter of the first burner 202, while outlets 208 are generally spaced apart about a perimeter of the second burner 204.

As illustrated, second burner 204 has a shape that is different from the shape of the first burner 202. First burner 202 in exemplary embodiments has a circular shape, as illustrated. Such shape facilitates the use of generally circular cooking utensils with the burner assembly 110. Second burner 204 has a non-circular shape. For example, in exemplary embodiments as illustrated, second burner 204 has a generally oval shape, and includes opposing long straight sides 210 and opposing short curved sides 212. Each short curved side 212 is connected to ends of the opposing long straight sides 210 to form the general shape of the burner 204. Alternatively, second burner 204 may include long curved sides and/or short straight sides, or may have any other suitable shape.

Further, in exemplary embodiments, first burner 202 may be generally smaller than second burner 204. For example, a maximum diameter (or width) 216 of the first burner 202 may be less than a length 218 of either of the opposing short curved sides 212. Thus, an overall surface area of the first burner 202 when viewed from above (referring briefly to FIGS. 5 through 9, for example) may fit within an overall surface area of the second burner 204. Alternatively, first burner 202 may be generally equal to or greater in size than the second burner 204, and/or the overall surface area of the first burner 202 may not fit within the overall surface area of the second burner 204.

As further illustrated, second burner 204 in exemplary embodiments may include opposing burner portions 220. The opposing burner portions 220 may be spaced apart, as illustrated, such that the first burner 202 may be disposed between the burner portions 220. Further, a seating portion 222 of the second burner 204 may be disposed between and may space apart the opposing burner portions 220, and the first burner 202 may be disposed in the seating portion 222.

In exemplary embodiments, apertures 224 may be defined in the second burner 204, such as in the seating portion 222. Each aperture 224 may be disposed between the first burner 202 and one of the opposing burner portions 220, for example. Apertures 224 may facilitate the flow of secondary air to the first burner 202, thus allowing clean, efficient first burner 202 operation.

Top covers 232, 234 may be provided on the burners 202, 204 to cover the outlets 208, 210, as illustrated. Further, baseplate 240 may be provided, and burners 202, 204 may be disposed on and extend through baseplate 240. For example, inlet bores 242, 244 of the first burner 202 and second burner 204 respectively, which may be in fluid communication with gaseous fuel supply 122, may extend through apertures 246, 248 defined in the baseplate 240. Gaseous fuel may be supplied from fuel supply 122 through valve 120 to the inlet bores 242, 244, and from inlet bores 242, 244 to outlets 206, 208 of burners 202, 204. It should be understood that in exemplary embodiments as shown, valve 120 is a duel outlet valve which selectively provides gaseous fuel to burner 202 and/or burner 204 as required and per knob 114 positioning as discussed below. Additional apertures 250 may be defined in the baseplate 240 to facilitate air flow to and through apertures 224 and to the first burner 202.

Burner assembly 110 may additionally include an igniter 260. Igniter 260 may, for example, provide a spark to ignite gaseous fuel from fuel supply 122. For example, in exemplary embodiments, igniter 260 may be positioned to interact with gaseous fuel being supplied through inlet bore 242 of first burner 202. Alternatively, igniter 260 may be positioned to interact with gaseous fuel being supplied through inlet bore 244 of first burner 204. Igniter 260 may, for example, be operated by knob 114 when knob 114 is placed in an ignite position in which gaseous fuel flows through one or both inlet bores 242, 244 and igniter 260 operates to ignite such gaseous fuel.

Referring now to FIGS. 5 through 9, embodiments of burner assembly 110 having various gaseous fuel levels, and thus various power output and flame levels, are illustrated. As discussed, the gaseous fuel supply to the burner 202 and burner 204 may be controlled by knob 114, which may be connected to valve 120. Knob 114 may thus be movable, such as in exemplary embodiments rotatable, to and through various positions which may cause valve 120 to provide various levels of gaseous fuel to the respective burners 202, 204.

For example, as illustrated in FIG. 5, knob 114 may be movable to a first position wherein the first burner 202 outputs a maximum gaseous fuel supply and the second burner 204 outputs no gaseous fuel supply. As illustrated in FIG. 6, knob 114 may further be movable to a second position wherein the first burner 202 outputs a minimum gaseous fuel supply and the second burner 204 outputs no gaseous fuel supply. As illustrated in FIG. 7, knob 114 may further be movable to a third position wherein the first burner 202 outputs a minimum gaseous fuel supply and the second burner 204 outputs a maximum gaseous fuel supply. As illustrated in FIG. 8, knob 114 may further be movable to a fourth position wherein the first burner 202 outputs a minimum gaseous fuel supply and the second burner 204 outputs a minimum gaseous fuel supply. In some embodiments, as illustrated in FIG. 9, knob 114 may further be movable to a fifth position wherein the first burner 202 outputs no gaseous fuel supply and the second burner 204 outputs a minimum gaseous fuel supply.

In exemplary embodiments, the knob 114 is movable sequentially from the first position to the second position, and vice versa. Thus, movement of the knob 114 from the first position to the second position may reduce the gaseous fuel supply from the first burner 202 from a maximum to a minimum. In other exemplary embodiments, the knob 114 is movable sequentially from the third position to the fourth position, and vice versa. Thus, movement of the knob 114 from the third position to the fourth position may reduce the gaseous fuel supply from the second burner 204 from a maximum to a minimum, while the gaseous fuel supply from the first burner 202 remains at a minimum.

Further, in some exemplary embodiments, knob 114 is movable sequentially to the first position, then the second position, then the third position, and then the fourth position. In these embodiments, the first burner 202 gaseous fuel supply is advantageously reduced to a minimum before a gaseous fuel supply is provided to the second burner 204. In other embodiments, the knob 114 is movable sequentially to the third position, then the fourth position, then the first position, and then the second position. In these embodiments, the second burner 204 gaseous fuel supply is advantageously eliminated before a maximum gaseous fuel supply is provided to the first burner 202. Such sequential movements advantageously prevent excess heat issues for the burner assembly 110. For example, such operation advantageously prevents damage to cooking utensils (such as pots or pans) used with burner assembly 110 due to the prevention of excess heat issues. Additionally, users are protected from exposed burner flames, such as when only first burner 202 operation is desired.

It should be understood that sequential movement, as discussed herein, is generally movement in a constant direction to and through various positions. For example, in embodiments wherein knob 114 is rotatable, sequential movement from the first position to the second position means that the knob 114 may be rotated in a single direction from the first position to the second position.

In exemplary embodiments, the power output of the burner assembly 110 when the knob 114 is in the third position is approximately equal to the power output when the knob 114 is in the first position. Thus, the sum of the power output by the ignited first burner 202 operating at a minimum gaseous fuel supply and the power output by the ignited second burner 202 operating at a maximum gaseous fuel supply may be approximately equal to the power output by the ignited first burner 202 operating at a maximum gaseous fuel supply. Thus, when in the third position, the power output by the burner assembly 110 may not cause overheating.

Such various knob positions and relative gaseous fuel supplies may provide various advantages for the burner assembly 110 and cooktop appliance 100 in general. For example, the sequence of operation of the gaseous fuel supply may be efficient and easy to understand for a user. Further, by preventing simultaneous maximum gaseous fuel supply by both the first and second burners 202, 204, excess heat issues are prevented.

The present disclosure is further directed to methods for operating burner assemblies 110 of cooktop appliances 100. A method may include, for example, outputting a maximum gaseous fuel supply to a first burner 202 and no gaseous fuel supply to the second burner 204 when a burner assembly knob 114 is in a first position, as illustrated in FIG. 5. A method may further include, for example, outputting a minimum gaseous fuel supply to the first burner 202 and no gaseous fuel supply to the second burner 204 when the knob 114 is in a second position, as illustrated in FIG. 6. A method may further include, for example, outputting a minimum gaseous fuel supply to the first burner 202 and a maximum gaseous fuel supply to the second burner 204 when the knob 114 is in a third position, as illustrated in FIG. 7. A method may further include, for example, outputting a minimum gaseous fuel supply to the first burner 202 and a minimum gaseous fuel supply to the second burner 204 when the knob 114 is in a fourth position, as illustrated in FIG. 8.

Further, in some embodiments, a method may further include, for example, outputting no gaseous fuel supply to the first burner and a minimum gaseous fuel supply to the second burner when the knob is in a fifth position, as illustrated in FIG. 9.

Still further, in some embodiments, a method may further include, for example, igniting the gaseous fuel, as discussed above. In exemplary embodiments, only one ignition, such as of the gaseous fuel supply to the first burner 202, may be required. In these embodiments, the gaseous fuel supply to the second burner 204 may be ignited by the resulting flames from the first burner 202. Such ignition may, in exemplary embodiments, occur when the knob 114 is moved to an ignition position, which may be sequentially before the first position or the third position.

As discussed above, in some embodiments, knob 114 is movable sequentially from the first position to the second position. In other embodiments, knob 114 is movable sequentially from the third position to the fourth position.

Further, in some embodiments, knob 114 is movable sequentially to the first position, then the second position, then the third position, and then the fourth position. In other embodiments, knob 114 is movable sequentially to the third position, then the fourth position, then the first position, and then the second position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A burner assembly of a cooktop appliance, the burner assembly comprising:

a baseplate;

a first burner defining a plurality of outlets for directing gaseous fuel therefrom, the first burner being disposed on the baseplate;

a second burner defining a plurality of outlets for directing gaseous fuel therefrom, the second burner being disposed on the baseplate and having a shape different from a shape of the first burner; and a knob operable to control a gaseous fuel supply to the first burner and a gaseous fuel supply to the second burner, the knob movable to a first position wherein the first burner outputs a maximum gaseous fuel supply and the second burner outputs no gaseous fuel supply, a second position wherein the first burner outputs a minimum gaseous fuel supply and the second burner outputs no gaseous fuel supply, a third position wherein the first burner outputs a minimum gaseous fuel supply and the second burner outputs a maximum gaseous fuel supply, and a fourth position wherein the first burner outputs a minimum gaseous fuel supply and the second burner outputs a minimum gaseous fuel supply, wherein the second burner comprise opposing burner portions and a seating portion between the opposing burner portions, the first burner being disposed in the seating position, wherein the second burner defines at least one aperture in the seating portion between the first burner and one of the opposing burner portions, wherein the second burner further comprises a top cover extending over the at least one aperture, and wherein the baseplate defines an additional aperture below the at least one aperture and top cover of the second burner to facilitate airflow through the at least one aperture to the second burner.

2. The burner assembly of claim 1, wherein the knob is movable sequentially from the first position to the second position.

3. The burner assembly of claim 1, wherein the knob is movable sequentially from the third position to the fourth position.

4. The burner assembly of claim 1, wherein the knob is movable sequentially to the first position, then the second position, then the third position, and then the fourth position.

5. The burner assembly of claim 1, wherein the knob is movable sequentially to the third position, then the fourth position, then the first position, and then the second position.

6. The burner assembly of claim 1, wherein a power output in the third position is approximately equal to a power output in the first position.

7. The burner assembly of claim 1, further comprising a valve configured to supply gaseous fuel to the first burner and the second burner, the knob operably connected to the valve.

8. The burner assembly of claim 1, wherein the second burner has a generally oval shape comprising opposing long straight sides and opposing short curved sides.

9. The burner assembly of claim 8, wherein the first burner has a circular shape having a diameter less than lengths of the opposing short curved sides.

10. A method for operating a burner assembly of a cooktop appliance, the burner assembly comprising a first burner and a second burner each defining a plurality of outlets for directing gaseous fuel therefrom, the second burner having a shape different from a shape of the first burner and defining an aperture between the first burner and the second burner, the burner assembly further comprising a baseplate on which the first burner and the second burner are disposed, the baseplate defining an additional aperture beneath the second burner, the method comprising:

outputting a maximum gaseous fuel supply to the first burner and no gaseous fuel supply to the second burner when a burner assembly knob is in a first position;

outputting a minimum gaseous fuel supply to the first burner and no gaseous fuel supply to the second burner when the knob is in a second position;

outputting a minimum gaseous fuel supply to the first burner and a maximum gaseous fuel supply to the second burner when the knob is in a third position, wherein a power output in the third position is approximately equal to a power output in the first position; and outputting a minimum gaseous fuel supply to the first burner and a minimum gaseous fuel supply to the second burner when the knob is in a fourth position.

11. The method of claim 10, wherein the knob is movable sequentially from the first position to the second position.

12. The method of claim 10, wherein the knob is movable sequentially from the third position to the fourth position.

13. The method of claim 10, wherein the knob is movable sequentially to the first position, then the second position, then the third position, and then the fourth position.

14. The method of claim 10, wherein the knob is movable sequentially to the third position, then the fourth position, then the first position, and then the second position.

15. The method of claim 10, further comprising igniting the gaseous fuel.

16. The method of claim 10, further comprising outputting no gaseous fuel supply to the first burner and a minimum gaseous fuel supply to the second burner when the knob is in a fifth position.

17. The method of claim 10, wherein the knob is operably connected to a valve, the valve configured to supply gaseous fuel to the first burner and the second burner.

* * * * *